United States Patent [19]

Dressler

[11] Patent Number: 5,044,581

[45] Date of Patent: Sep. 3, 1991

[54] GUTTER GUARD SCREEN SUPPORT CLIP

[75] Inventor: Robert D. Dressler, Mechanicsburg, Pa.

[73] Assignee: Alumax Aluminum Corporation, Lancaster, Pa.

[21] Appl. No.: 637,659

[22] Filed: Jan. 7, 1991

[51] Int. Cl.[5] ..... E04D 13/06

[52] U.S. Cl. ..... 248/48.1; 52/12

[58] Field of Search ..... 248/48.1, 48.2; 52/12, 52/11, 94, 95, 96; 210/444

[56] References Cited

U.S. PATENT DOCUMENTS

| | | | |
|---|---|---|---|
| 2,431,012 | 11/1944 | Alig | 248/48.1 |
| 3,428,183 | 2/1969 | Briston | 52/12 X |
| 4,305,236 | 12/1981 | Williams | 248/48.1 X |
| 4,553,356 | 11/1985 | Pepper | 52/11 |
| 4,553,357 | 11/1985 | Pepper | 248/48.1 X |
| 4,573,290 | 3/1986 | Fleming | 248/48.1 X |
| 4,592,174 | 6/1986 | Hileman | 210/474 X |
| 4,745,710 | 5/1988 | Davis | 52/94 X |
| 4,796,390 | 1/1989 | Demartini | 52/96 X |
| 4,876,827 | 10/1989 | Williams | 248/48.1 X |
| 4,936,061 | 6/1990 | Palma | 52/11 X |

FOREIGN PATENT DOCUMENTS

| | | | |
|---|---|---|---|
| 2201324 | 6/1973 | Fed. Rep. of Germany | 52/12 |

*Primary Examiner*—J. Franklin Foss

*Attorney, Agent, or Firm*—Hartman Underhill & Brubaker

[57] ABSTRACT

A clip for supporting a guard screen on a rain gutter to keep leaves and other debris from entering the gutter, the clip extending from an outer to an inner wall of the gutter and having means for attaching the clip thereto, the screen being supported on the clip, means being provided to attach the screen to the clip preventing upward movement of the screen relative to the clip and longitudinal movement of the screen relative to the gutter.

10 Claims, 2 Drawing Sheets

Fig. 3
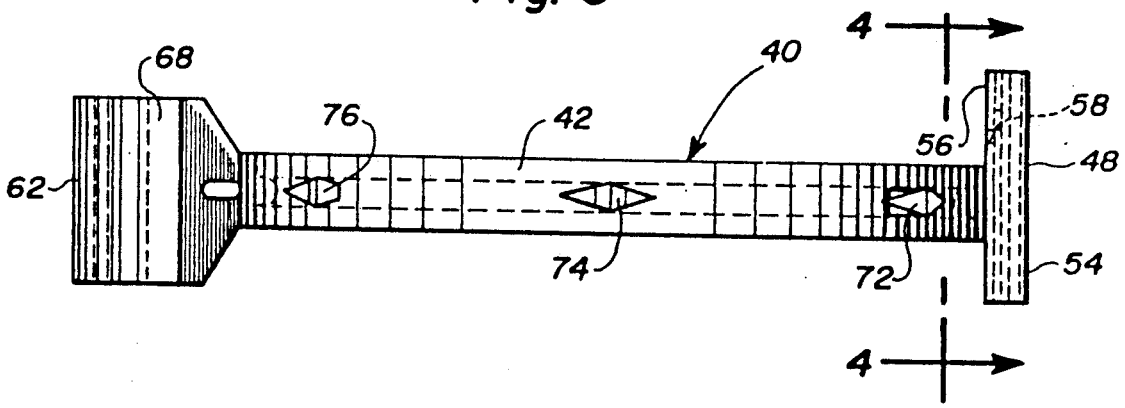
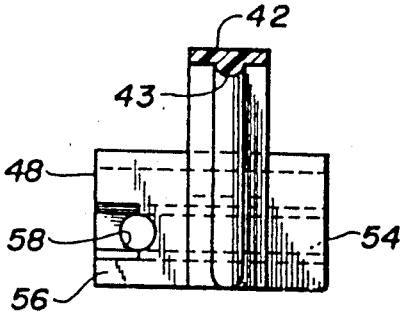
Fig. 4
Fig. 5a
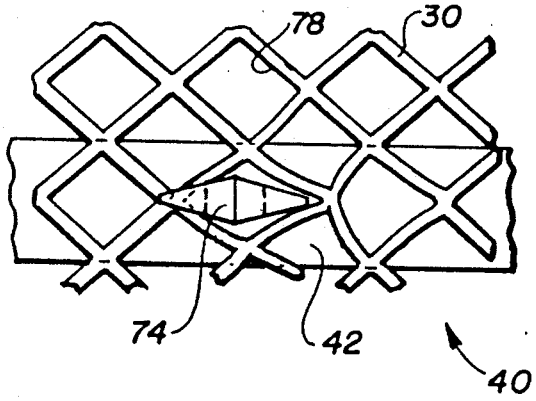
Fig. 5b
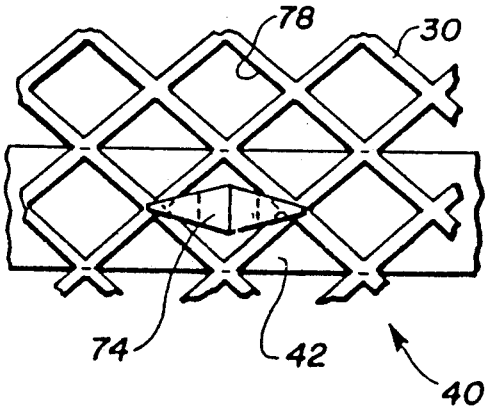

GUTTER GUARD SCREEN SUPPORT CLIP

FIELD OF INVENTION

This invention relates to a clip for use in installing screening over a rain gutter.

BACKGROUND OF THE INVENTION

To prevent the accumulation of leaves and other debris in gutters, screening is available to keep material from entering and at the same time permitting the free passage of rain water. The screen material commonly comes in a roll having a width which will traverse the upper open end of the gutter, from the gutter inside wall to the outer wall thereof.

The screen is usually made of light mesh wire, manufactured from aluminum, plastic or other material. The gauge is such as to enable screen six inches wide, or the like, to be rolled into a package, for example, 20 feet long, and subject to being rolled out to provide a gutter cover.

Such a screen involves some difficulties to install. As it is unrolled, the screen has a tendency to return to its rolled form. If it is desired to have the screen applied in one continuous long piece, when it is attached at one end of the gutter and then rolled out towards the opposite end, the portion first installed may come loose and roll up when the person is locating the opposite end of the screen.

One way to overcome this is to cut the screen into short sections about 3 feet long so that the installer can handle both ends of a given piece of screen at one time. In such an installation, the screen sections may be overlapped.

Installation is also difficult because of the lightness of the screen and because of a tendency of the screen to collapse when in place. When heavy debris comes in contact with the screen, it may cause the screen to cave into the gutter rather than support material on top of the screen.

SUMMARY OF INVENTION

This invention provides a gutter guard screen clip which will support screen when applied to cover a gutter, the clip holding the screen securely and preventing the screen from collapsing when in place. The clip restrains the screen from moving outwardly of the gutter or longitudinally relative to the extension of the gutter.

An object of this invention is to provide a gutter screen clip which will allow the screen to be applied in one continuous long piece and held in an arched form whereby leaves and the like will tend to fall off the screen when prevented from entering the gutter.

Another object of this invention is to provide means on a gutter screen clip for connecting a screen to the clip without the use of tools, the connection being such that the screen can be readily attached and also disconnected from the clip.

A further object of this invention is to provide a clip which will hingedly connect to the upper outer end wall of a gutter and frictionally connect to the upper inner end wall of the gutter.

DRAWINGS

In the drawings:

FIG. 3 is a plan view of FIG. 2;

FIG. 4 is a section taken on the line 4—4 of FIG. 3 looking in the direction of the arrows; and FIGS. 5*a* and 5*b* are enlarged views showing how the screening is applied on top of the support clip and connected thereto through spikes on the clip.

DESCRIPTION

Figure 1:
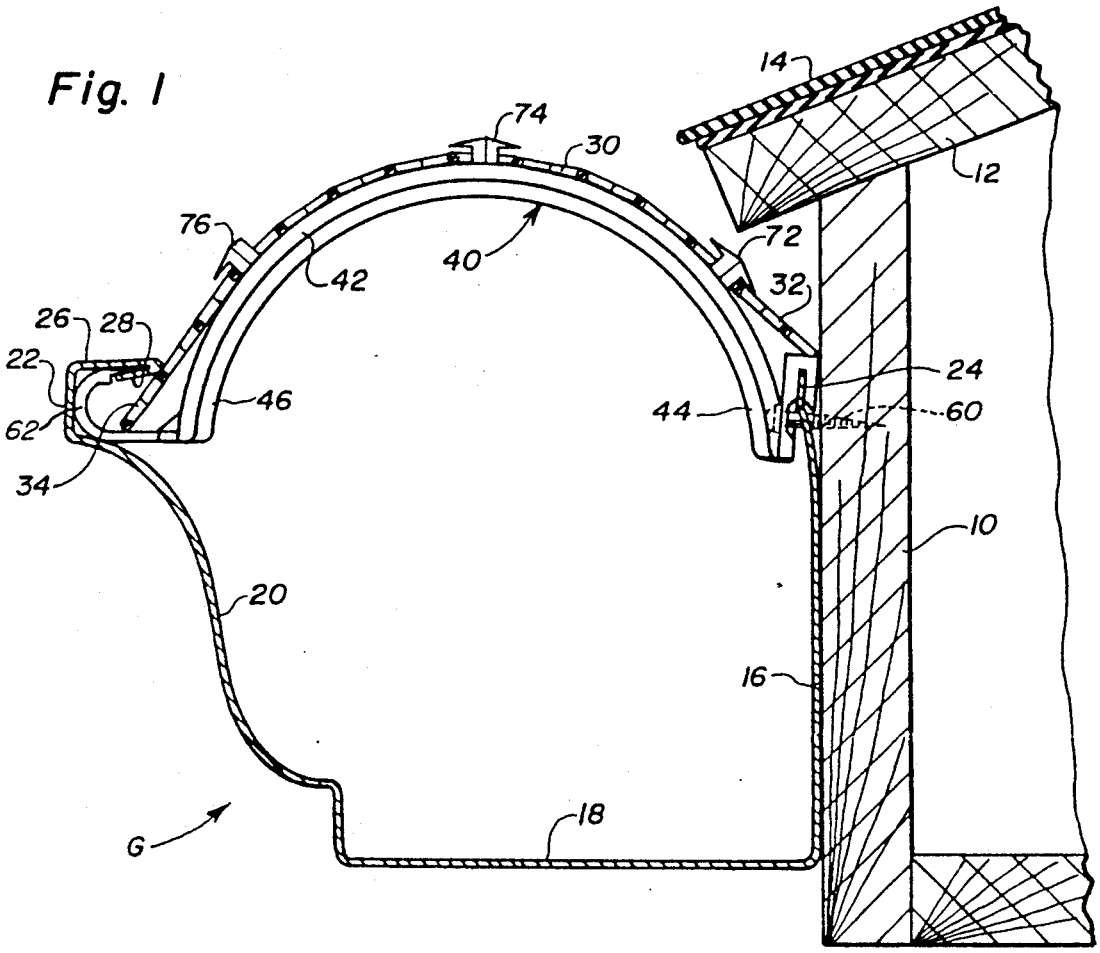
FIG. 1 is a vertical cross section showing a standard gutter attached below the terminal overhanging edge of a roof and having a gutter screen extended from an inner to an outer edge of the gutter supported by a clip constructed according to this invention.

Referring now to the drawings by numerals of reference, 10 is the side wall of a house having a slanted roof 12 which overhangs wall 10. Roof 12 has shingles 14 over which rain water will pass downwardly and outwardly. As shown in FIG. 1 the overhang of the roof is limited so that water coming from the roof will drop downwardly into a gutter G.

The gutter G shown is of conventional, standard design including a vertically extending inner wall 16, a horizontally extending bottom wall 18 and a curved outer wall 20. At its upper outer end, wall 20 has a U-shaped free-end portion 22 with its open side or bite of the U facing inwardly toward the upper end 24 of inner wall 16. End 24 and U-shaped portion 22 are generally in the same horizontal plane. Portion 22 of the gutter has an upper horizontal ledge 26 and a folded over piece 28.

When it rains, water drains downwardly and to the left of FIG. 1 from the roof shingles 14 and drops into the gutter G for disposal through downwardly directed drain spouts, not shown. To prevent leaves and other debris from accumulating in the gutter G, a screen of mesh material 30 is located across the upper open end of gutter G. The screen may be made of plastic, aluminum or other material. It is flexible The width of the screen material is such that it extends from an inside end 32 adjacent house wall 10 to an outer end 34 adjacent the free U-shaped end 22 of the gutter.

To securely mount screen 30 across the gutter, a support clip 40 is provided constructed according to this invention. Clip 40 has a body portion 42 which is arched or domed-shaped when viewed from the side, FIGS. 1 and 2. Body 42 has a strengthening rib 43. Clip 40 is preferably made of a plastic or metal strong enough to firmly support gutter screen 30 but it has some flexibility so that the inner end 44 of the clip and the outer end 46 of the clip may be flexed toward and away from each other to obtain proper positioning of the clip.

Figure 2:
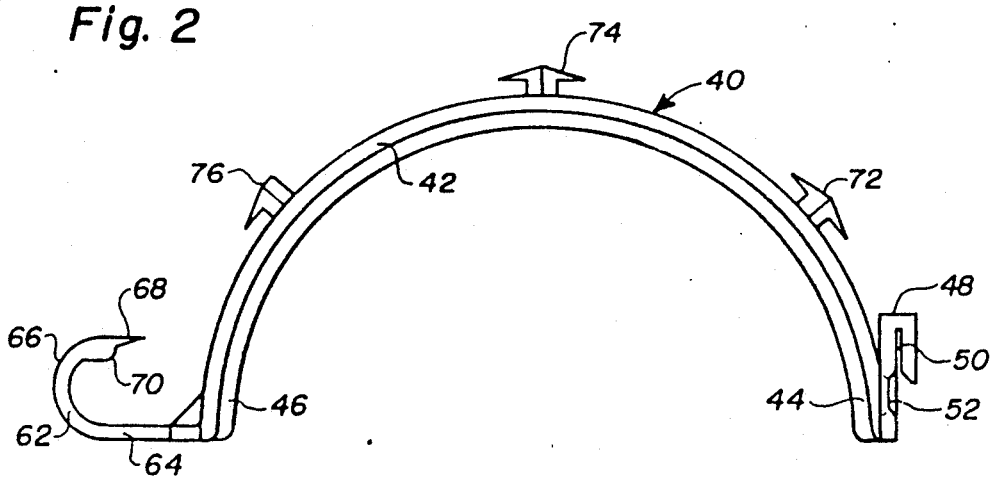
FIG. 2 is an enlarged side view of the screen support clip shown in FIG. 1.

At the inner end 44, clip 40 is provided with a transverse integral section 48, FIGS. 2, 3 and 4, slotted at 50 and with a depression 52 to receive the upper inner edge 24 of the inside gutter wall 16.

As shown in FIG. 4, portion 48 of the clip has a section 54 which extends laterally to one side of the clip body 42 and a section 56 which extends laterally on the opposite side of the clip. Section 56 is provided with a hole 58 through which a screw 60 (FIG. 1) can be projected to fasten the inner end 44 of clip 40 to the side wall 10 of the house. However, such a screw is not required. If desired, the installer can merely frictionally connect clip 40 to the gutter wall 16.

At its opposite end 46, support clip 40 is provided with a U-shaped section 62 designed to snugly fit within the U-shaped portion 22 of the gutter G. The portion 62 provides a hinged connection with the gutter, there being a bottom wall 64, a curved wall 66 and an upper tapered free edge 68 adapted to slide into the space between the ledge 26 of the gutter and the inwardly projecting piece 28. A rib 70 is formed on hinge piece 62 to strengthen the part and also limit the extension of the edge 68 into the gutter outer edge between 26 and 28, FIG. 1.

Projecting upwardly from the arched, domed body 42 of clip 40 are three molded holding spikes indicated at 72, 74 and 76. Spikes 72 and 74 are generally of the same configuration. Spike 74 is located generally in the middle of the body 42 and projects upwardly. Spike 72 is located adjacent the inner end 44 of clip 40 beneath the roof edge. The other spike 76 is located along the upper edge of end 46 of body 42 of clip 40 adjacent the outer edge 22 of gutter G.

When viewed from above, as shown in FIGS. 5*a* and 5*b*, spikes 72 and 74 are diamond-shaped and adapted to fit within the mesh openings 78 in the screen 30. The screen material, being flexible, will readily slip over the spikes 72 and 74 when pulled by the installer as shown in FIG. 5*a* and released as shown in FIG. 5*b*. The size of each spike is such as to hold screen 30 down, FIGS. 1 and 5*b*, when the screening has been attached thereto.

The outer spike 76 is constructed without the inner point of the diamond so that only a half portion of the spike is provided. This facilitates the attachment of the screen to the clip and to the other spike 72 and 74.

To apply screening to a gutter, a series of clips are applied to the gutter as shown in FIG. 1, at longitudinally spaced locations along the gutter, such as two or three feet apart. Each clip 40 is attached to gutter G by sliding the U-shaped portion 62 into the U-shaped section 22 of the gutter. The curved section 66 pivots and slides against the surface of the gutter and is rotated into place until the edge 68 comes into engagement with the turned over portion 28 of the gutter. After the outer end of the clip is in place, the inner end of clip is attached to the upper edge 24 of the wall 16 of the gutter G by snapping the clip onto the gutter edge by inserting the edge 24 into slot 50, guided by depression 52. A frictional connection occurs between the clip and gutter wall upper end 24. When in place, each clip 40 can be fastened to the house wall using a screw 60, if desired.

When a series of the clips are mounted as shown, screen 30 may be applied. The installer unrolls the screen and inserts the outer portion 34 of the screen between the end 46 of the clip and the U-shaped edge 22 of gutter G. The screen is passed over half spike 76 and then attached to spike 74 and finally spike 72. The inner edge 32 of the screening rests on top of the portion 48 of the clip 40.

The installer unrolls the screening and moves along the gutter to attach the screen to each clip 40 in succession as the clips are reached. There is no need to cut the screen into short lengths. The entire 20-foot or more length of the roll of gutter guard screen can be applied in one continuous piece. Since there is no overlapping of screen sections, the screen will be effective for its full length to guard a gutter.

When in place, the screen assumes an arched configuration, FIG. 1, high in the middle and low on either side edge. This arched or domed shape facilitates the discharge of leaves and other material from the screen when such debris lands on the screen. The leaves will easily fall off or blow away. Any entrance of debris into the gutter is prevented.

The retaining spikes 72, 74 and 76 hold the screening from moving upwardly from the clips 40 when mounted in place. Further, these spikes prevent longitudinal movement of the screening along the length of gutter G.

With the clips 40 constructed according to this invention, screen may be readily and quickly applied to a gutter without special tools. However, depending upon the desire of the installer each clip may be connected to the side of the house using a screw 60 for each clip. Further, depending upon the degree of flexibility of the screening, a straight bladed screwdriver may be employed to stretch the screen as shown in FIG. 5*a* to apply the screen to the holding spikes.

Although a specific configuration is shown, it will be understood that the invention is subject to modification without departing from the concept disclosed.

Having thus described my invention, what I claim is:

1. A support clip for a screen on a gutter to keep debris from entering the gutter, wherein, the gutter has a vertically extending inner wall, a horizontally extending bottom wall and an upwardly and outwardly extending outer wall, said inner wall being attachable to a building below an adjacent terminal edge of a roof and having an upper free edge, said outer wall terminating in an upper free edge across from the upper edge of the inner wall, and wherein a flexible screen is provided to extend from the upper ends of said inner and outer gutter walls, said support clip comprising a body extendable from the upper ends of said gutter inner and outer walls, means providing a rotatable hinged connection of said clip to the upper end of said outer wall, means for detachably connecting the opposite end of said clip to the upper end of said inner wall, said screen when extended across said gutter being supported by said clip, and means on said clip and projectable through openings in said screen to secure the screen to the clip and prevent movement of the screen upwardly and longitudinally relative to the gutter.

2. A support clip for a screen on a gutter as recited in claim 1 wherein said clip is dome shaped, having a high middle portion and lower opposite ends, whereby the screen is arched when supported on the clip over the gutter to provide a self-cleaning configuration.

3. A support clip as recited in claim 1 wherein the gutter has a U-shaped free end at the upper end of the outer wall, said clip having a curved U-shaped portion at one end which slidably fits into the free end of the gutter to provide said rotatable hinged connection.

4. A support clip as recited in claim 3 wherein said U-shaped portion on said clip has a stop which engages a piece on the gutter and limits the rotation of the clip in one direction.

5. A support clip as recited in claim 4 wherein said U-shaped portion on said clip has a tapered edge which interfits with the gutter upper outer wall and attaches one to the other.

6. A support clip as recited in claim 1 wherein a member is provided on the clip at an inner end thereof and slotted to frictionally fit over the upper end of the gutter inner wall and detachably connects thereto.

7. A support clip as recited in claim 6, wherein said member has a lateral portion provided with a hole for a fastener to enable a fixed attachment of the clip to the gutter supporting structure.

8. A support clip as recited in claim 1 wherein said clip has a plurality of upwardly extending spikes adapted to project through the mesh in the screen and of such size relative to the mesh openings to secure the screen in place and prevent outward and longitudinal movement of the screen relative to the gutter.

9. A support clip as recited in claim 8 wherein there are diamond shaped spikes, the length of which is greater than the width of the mesh openings in the flexible screen, the screen being stretched over the spikes when mounted in place and held thereon, and there being one half size spike to also hold the screen in place.

10. A support clip for a screen on a gutter to keep debris from entering the gutter, wherein the gutter has a vertically extending inner wall, a horizontally extending bottom wall, and an upwardly and outwardly extending outer wall, said inner wall being attachable to a building below an adjacent terminal edge of a roof and having an upper free edge, said outer wall terminating in an upper free end and U-shaped with the bite of the U facing inwardly, the ends of the inner and outer walls being generally in the same horizontal plane, and wherein the screen is flexible and extends from the upper ends of the inner and outer walls, said support clip comprising a dome shaped body mountable on the inner and outer walls of the gutter, said body being high in the middle and lower at each end, one end of said clip having a curved U-shaped portion which fits into the U-shaped upper outer end wall of the gutter and provides a rotatable hinged connection therewith, means engagable with the gutter for limiting the rotation of said clip one end in one direction, a member on an opposite end of the clip and slotted to receive the upper end of the gutter and provide a frictioned attachment thereto, at least three spikes extending upwardly from said clip body, a first spike being adjacent the gutter inner wall, a second spike being adjacent the gutter outer wall and a middle spike centrally located between the ends of the clip, the screen being mountable on the clip with said spikes projecting through mesh openings in the screen, said first and middle spikes being of longer width than the screen mesh openings, said second spike being smaller than a screen opening, said screen being stretchable over the spikes to attach thereto, and said spikes holding the screen on said clip from upward movement relative thereto and longitudinal movement relative to the extension of the gutter.

* * * * *